US009573177B2

(12) United States Patent
Cernuschi et al.

(10) Patent No.: US 9,573,177 B2
(45) Date of Patent: Feb. 21, 2017

(54) THREE-ROLL ROLLING MILL STAND WITH SIDE CHANGE WITH RESPECT TO THE ROLLING LINE

(71) Applicant: Danieli & C. Officine Meccaniche S.P.A., Buttrio (IT)

(72) Inventors: Ettore Cernuschi, Castelletto Sopra Ticino (IT); Aristide Giacomo Bertelli, Bresso (IT)

(73) Assignee: Danieli & C. Officine Meccaniche S.P.A., Buttrio (IT)

( * ) Notice: Subject to any disclaimer, the term of this patent is extended or adjusted under 35 U.S.C. 154(b) by 153 days.

(21) Appl. No.: 14/535,179

(22) Filed: Nov. 6, 2014

(65) Prior Publication Data

US 2015/0128678 A1 May 14, 2015

(30) Foreign Application Priority Data

Nov. 8, 2013 (IT) ..... MI2013A01860

(51) Int. Cl.

| | |
|---|---|
| ***B21B 31/08*** | (2006.01) |
| ***B21B 31/02*** | (2006.01) |
| ***B21B 31/10*** | (2006.01) |
| ***B21B 17/14*** | (2006.01) |

(52) U.S. Cl.

CPC ..... *B21B 31/08* (2013.01); *B21B 17/14* (2013.01); *B21B 31/10* (2013.01); *B21B 31/103* (2013.01); *B21B 2203/06* (2013.01)

(58) Field of Classification Search

CPC ..... B21B 13/10; B21B 13/103; B21B 17/02; B21B 17/04; B21B 17/06; B21B 17/14; B21B 31/02; B21B 31/08; B21B 31/10; B21B 31/103; B21B 31/106; B21B 31/12; B21B 31/14; B21B 31/16; B21B 31/20; B21B 31/203; B21B 31/32; B21B 2031/023; B21B 2031/026; B21B 2203/06; B21B 2203/10; B21B 2203/28; B21B 2203/32

USPC ..... 72/224, 235, 237–240

See application file for complete search history.

(56) References Cited

FOREIGN PATENT DOCUMENTS

| | | |
|---|---|---|
| EP | 2313212 | 4/2011 |
| JP | 2000271618 | 10/2000 |
| WO | WO2009014141 | 11/2009 |
| WO | WO2011132094 | 10/2011 |

*Primary Examiner* — Peter DungBa Vo
*Assistant Examiner* — Joshua D Anderson
(74) *Attorney, Agent, or Firm* — Stetina Brunda Garred & Brucker

(57) ABSTRACT

A roll-holder cartridge for a three-tube rolling stand with means adapted to release a tube during rolling in case of emergency. The roll-holder cartridge (3) has on both side walls a substantially Y-shaped opening (10) laying with the foot at the vertical axis yoke support so as to be able to pull out the roll-holder cartridge according to a direction coinciding with the horizontal axis of the vertical axis yoke while leaving the support hanging from the fixed structure (13) of the rolling stand. In case of normal maintenance operation, the cartridge (3) is pulled out sideways from the structure of the rolling mill with the yoke support of the vertical axis roll anchored to the cartridge itself, like the other supports of the rolls.

12 Claims, 12 Drawing Sheets

THREE-ROLL ROLLING MILL STAND WITH SIDE CHANGE WITH RESPECT TO THE ROLLING LINE

CROSS REFERENCE TO RELATED APPLICATIONS

The present application claims priority to Italian Patent Application No. MI2013A0001860 filed Nov. 8, 2013, the entirety of the disclosures of which are expressly incorporated herein by reference.

STATEMENT RE: FEDERALLY SPONSORED RESEARCH/DEVELOPMENT

Not Applicable.

FIELD OF THE INVENTION

The present invention relates to a three-roll rolling mill stand used in rolling mills for the production of seamless tubular bodies, or rod-shaped bodies in general, in which each stand is made transversally with respect to the rolling line.

STATE OF THE ART

Rolling mills for the longitudinal rolling of tubes, or rod-shaped bodies in general, comprise assemblies of rolling stands with two or more rolls per stand. A rolling stand of the known type typically comprises, for each rolling roll:

- a hydraulic capsule for adjusting the radial position of the working roll with respect to the rolling axis of the rolling mill;
- a control extension, for example an adapter with Cardan joint and spine connector for engaging it onto the hub of the roll, to transmit rotary motion to the roll;
- a motor and a reducer, arranged on the other end of the control extension and connected thereto.

In particular, when three-roll rolling stands are used, the rolls of each rolling stand are held assembled in operating position by a roll-holder cartridge which facilitates assembly and disassembly of the rolling rolls of the stand. Indeed, using the roll-holder cartridge allows to extract the three rolls from the rolling mill at the same time in case of roll change for normal maintenance.

In a type of rolling mills for the longitudinal rolling of tubes according to the prior art, the roll-holder cartridges are changed by making them slide transversally with respect to the rolling axis. In this case, a side cartridge change with respect to the rolling stands is thus performed, and in particular in the systems in which the hydraulic capsules for adjusting and controlling the rolling pressure are rigidly fixed to the outer frame of the stand, capsule piston strokes are designed of such a length to allow the retraction of the capsule pistons also beyond the hindrance constituted by the path of the roll-holder cartridge, during its side extraction from the rolling mill. On the other hand, the rolling of tubes in rolling mills with three or more rolls per stand implies the need to operate with hydraulic capsules to adjust the radial position of the rolls which have a limited working stroke, in the order of 100-150 mm. Indeed, since rolling must be necessarily discontinuous due to the presence of the mandrel which must be inserted and pulled out from each rolled tube, in the moment in which the head end of the tube passes into each stand, the pressure inside the main chamber of the hydraulic capsule undergoes a sudden increase and, due to the elastic compressibility of the oil itself, the piston of the capsule retracts, normally by a few tenths of a millimeter, thus generating an undesired over-thickening of the tube wall in the end zone. The phenomenon is accentuated in the passage through each stand, accentuated by the gradual stiffening of the metal of the tube because, due to radiation, the ends of the tube are always colder and thus more resistant to deformation as they travel along the rolling line. For this reason, the capsule must necessarily have a limited stroke, to guarantee control dynamic suitability, e.g. by means of specific servo valves.

A three-roll stand with side extraction of the roll-holder cartridge is described in WO2011/132094. In a rolling mill of this type, in case of jamming of the tube during a rolling operation, at least one roll with respective yoke support is removed from operating position, making the support and the roll rotate about an axis parallel to the rolling axis, and obliging to cut the portion of jammed tube with the cartridge still inserted in the stand, and thus with limited access space to the tube.

A three-roll stand solution which provides a side extraction of the cartridge is described in patent EP2313212. In this solution, the cartridge and the three rolls are extracted together, and the rolls are extracted from the cartridge by means of a sliding movement in radial direction in the case of normal scheduled operations. This architecture of the rolling stand and of the cartridge is more advantageous than the solution in WO2011/132094 because the yoke supports can be extracted radially for cleaning the guides without opening the two half-shells.

However, in case of jamming, the extraction operation of the cartridge includes oxy-fuel cutting the portion of deformed tube and extracting cartridge, roll and cut tube stub all together with the rolling stand also in this architecture. Such an operation, in addition to being complicated, in all cases offers a limited space for cutting the jammed tube by means of a blow torch, making the cutting operation longer and more laborious.

In a constructive configuration as the one in EP2313212, it is felt the need to facilitate the extraction of the cartridge from the stand in case of jamming, thus improving rolling mill accessibility and maintaining the greater operative flexibility of such a type of cartridge when a side extraction of the cartridge is needed for normal maintenance.

SUMMARY OF THE INVENTION

It is the object of the present invention to make a rolling mill for rolling rod-shaped bodies, also of large size, which reduces the time and entity of the operation in case of emergencies caused by the tube jamming during the rolling process, and at the same time offers increased handling ease also for the regular maintenance operations which include extracting cartridge and rolls from the rolling stand.

The present invention thus suggests to reach the objects described above by making a rolling stand for tubes, defining a rolling axis X which, according to claim 1, comprises:

- a supporting structure,
- a roll-holder cartridge configured to go from a working position inside the supporting structure, at the rolling axis X, to an extracted position outside the supporting structure with a transverse movement with respect to the rolling axis X,
- three rolling rolls, each of which having a respective support, arranged in the roll-holder cartridge with respective symmetry axes arranged at 120° with respect to one another, a first roll of said three rolling rolls having the respective symmetry axis arranged horizontally and the respective rotation axis arranged vertically, at least one hydraulic capsule for each rolling roll, in order to adjust the radial position of the respective rolling roll, fixed to the supporting structure with a respective thrust cylinder, the at least one hydraulic capsule being configured to allow the respective thrust cylinder to cover a sufficient distancing stroke from the rolling axis X to allow to clear the path of the roll-holder cartridge between the working position and the extracted position, wherein the roll-holder cartridge has two first walls facing each other, each first wall having an opening equal to that of the other wall and defining three branches, wherein a first branch of the opening has elongated shape along the horizontal symmetry axis of the first roll, and wherein a second branch and a third branch have a symmetry axis arranged at a 120° angle with respect to the symmetry axis of the first roll, wherein the first branch is open at an end thereof coinciding with a side of the roll-holder cartridge, wherein the supporting structure has two second walls facing each other and there are three pairs of first axial resting surfaces on the inner surface of each of said two side walls, wherein each pair of first axial resting surfaces, when the cartridge is in said working position, is arranged so as to be in the first, second and third branches of the openings of the first walls of the roll-holder cartridge and facing, along the direction of the rolling axis X, to corresponding pairs of second axial resting surfaces integral with the support of the rolling rolls, whereby the rolling forces directed along the rolling axis X are directly discharged from the supports to the supporting structure.

Advantageously the first, second and third branches of the openings have a greater width in transversal direction than the diameter of the tube to be rolled.

With the open structure of the cartridge, the rolling stand of the invention thus allows to extract the cartridge itself in case of jammed tube without because of this making the cartridge and the stand as a whole less robust or more deformable under the working loads. Furthermore, by separating the yoke support relative to the vertical rotation axis working roll from the cartridge, the way has been found to rest the support and the roll themselves on fixed supports integral with the fixed structure of the rolling stand. The resolution of the previous technical problems has led to obtaining the structural relief of the forces, directed along the rolling axis X, directly from the yoke supports onto the fixed structure of the stand, thus avoiding to load the cartridge with these forces and allowing to make the structure of the cartridge lighter. Furthermore, the particular configuration of the cartridge geometry allows the radial extraction of all three rolling roll-yoke support assemblies without needing to disassemble the cartridge into two or more parts.

Using rolling stands according to the invention, a rolling mill for tubes consists of a plurality of rolling stands aligned in axial sequence and tipped by 180° one respect to the previous one and with respect to the vertical axis passing through the rolling axis. Consequently, the roll-holder cartridges are extracted from the rolling mill, when necessary, alternatively from the two sides of the rolling mill itself, again with an exclusively horizontal movement which facilitates the cartridge replacement operations because there are no weights arranged on inclined planes to be compensated during the changing operations, unlike in some known solutions which include the side change of the rolls.

A further advantage is that the side change of the roll holder cartridge allows to make the external structure of the rolling mill fixed with plates interposed between the cartridges, being these plates considerably stiffer than those of rolling mills characterized by the axial cartridge change.

A further advantage is that at least two pairs of first and second axial resting surfaces, arranged in the first branch of the openings, the one aligned with the first vertical rotation axis rolling roll, also comprise a sliding guide adapted to support the first vertical rotation axis roll vertically and the respective support in case of extraction of the cartridge from the supporting structure of the rolling stand, caused by a jamming of the tube.

Advantageously, in the undesired occurrence of rolled tube jamming, the yoke support which supports the roll arranged with the rotation axis vertical during rolling is released from the roll-holder cartridge and remains in position resting on guides obtained in the supporting structure of the rolling stand, while the cartridge, together with the other two rolls which have rotation axes inclined with respect to the vertical during rolling, is pull out laterally from the rolling stand structure by making it slide on guides or rails resting on the ground. In this particularly advantageous position for solving the jamming, the yoke support and the respective vertical rotation axis roll thus remain coupled to the roll moved away from the rolling axis, and hang from the fixed outer structure resting in particular stable manner on the guides obtained in the supporting structure of the rolling mill. In this manner, the separation of the roll-holder cartridge from the assembly defined by the vertical axis roll and respective support which remains mechanically supported, thus guaranteeing a total safety for performing the operations needed to solve the problem originated from the jamming.

It is further possible to provide a coaxial coupling device with the hydraulic capsule, e.g. a coupling device of the retractable hammer head rotational with respect to its axis, for retaining the yoke support of the vertical rotation axis roll on the capsule once it has been released from the roll-holder cartridge, if the degree of safety of the systems which guarantee maintaining the position also when the cartridge is completely extracted must be increased. Advantageously, the existing balancing device of each roll is used for this purpose. The coupling system, additional to the main one, is not normally necessary.

A further object of the invention is to provide a method for releasing a jammed tube from a rolling stand during the rolling operations from a rolling stand according to the invention, having the features described above, such a method comprising, in accordance with claim 13, the following steps in sequence:

a) blocking the two rolls with symmetry axis inclined with respect to the horizontal, to the roll-holder cartridge in a predetermined extraction position which does not hinder the path of the roll-holder cartridge from the supporting structure outwards, b) releasing control extensions from the three rolling rolls and positioning them so as to clear the path of the roll-holder cartridge, c) pulling out the roll-holder cartridge from the working position in the rolling stand to the extracted position by means of a side translation, leaving the yoke support with the respective first vertical rotation axis roll hanging from the supporting structure of the rolling stand.

In this manner, the problem of accessing the rolling axis in the case of jamming of the tube in the machine is solved by the solution suggested with the invention.

The advantages offered by this solution are numerous:

- more space in the stand structure for the cartridge when it must exit sideways during jamming;
- nearly total elimination of the deformation of the cartridge for loads directed along the rolling axis of the tube because the loads are relieved on the resting surfaces or fixed shoes arranged on the inner walls of the supporting structure of the rolling stand;
- less deformation of the cartridge for loads directed along the roll axis, but which generate a moment on the chock guides, which are relieved on the support structure of the rolling stand,
- increased safety for supporting the horizontal chock, which is used firstly to support the guides integral with the supporting structure of the rolling stand and, optionally, also with a hydraulic balancing system and resting on the inclined planes, if deemed necessary.

BRIEF DESCRIPTION OF THE FIGURES

Further features and advantages of the present invention will be more apparent in light of the detailed description of a preferred, but not exclusive, embodiment, of a rolling stand illustrated by the way of non-limitative example, with reference to the accompanying drawings, in which:

FIG. 11*a* is an enlarged view of a part of the view in FIG. 11;

Equal reference numbers in the various figures correspond to the same elements or components.

DETAILED DESCRIPTION OF PREFERRED EMBODIMENT OF THE INVENTION

Figure 1:
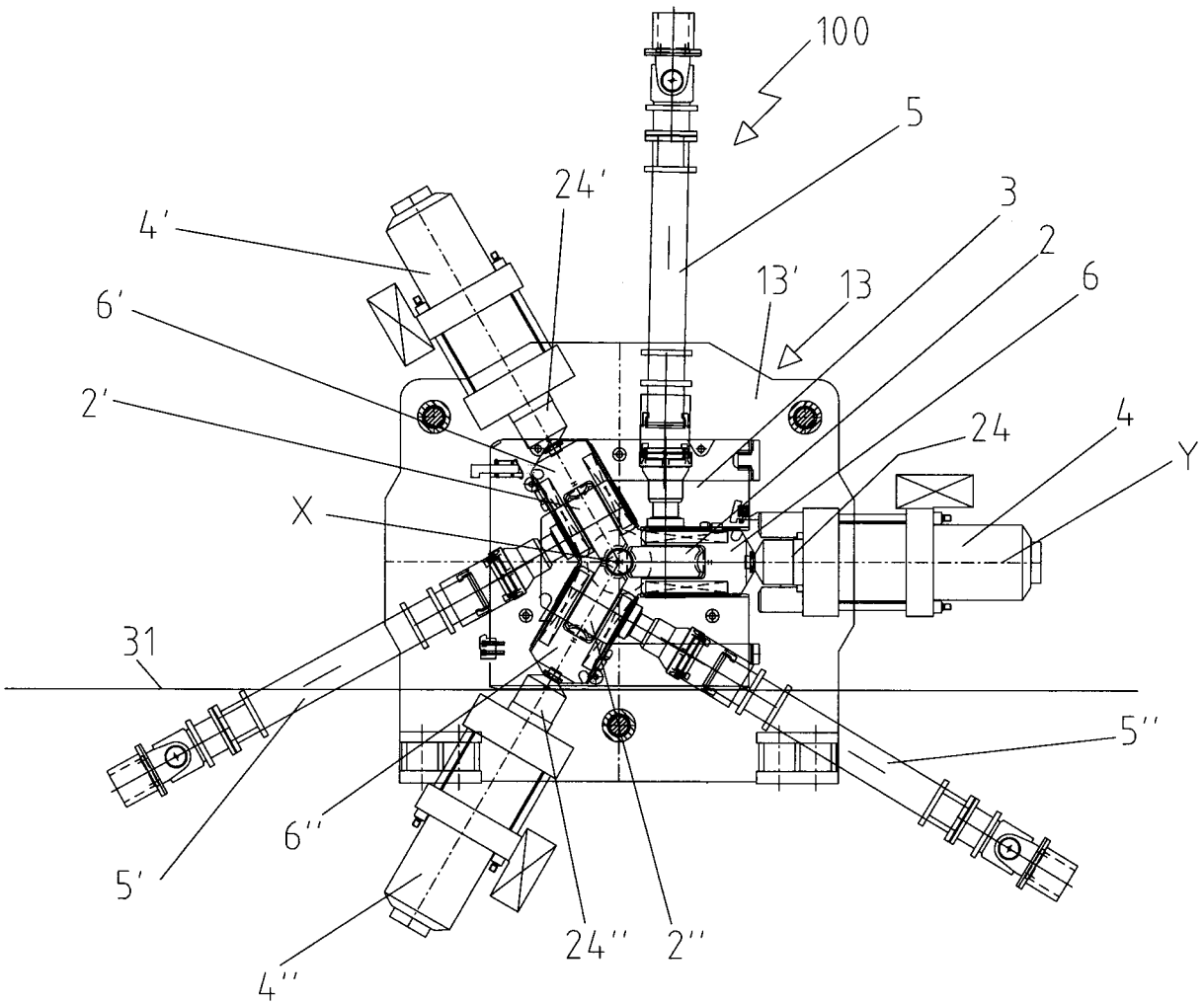
FIG. 1 is a cross view of the rolling stand according to the invention.

In FIG. 1, reference numeral 100 is a rolling stand of a rolling mill with several aligned stands each comprising three rolling rolls or working rolls 2, 2' and 2", arranged in a roll-holder cartridge 3 and centered on a rolling axis X.

Each roll is connected to a respective motor (not shown). A hydraulic capsule 4, 4', 4" is provided in each rolling stand 100, for each working roll 2, 2', 2" to adjust the radial position of the respective working roll 2, 2', 2" with respect to the rolling axis X of the rolling mill and to react to the separation force of the working rolls during rolling.

Advantageously, the hydraulic capsules 4, 4', 4" are all equivalent, with a respective piston 24, 24', 24" having an appropriate working stroke, and are rigidly fixed to the fixed structure 13 of the rolling mill, onto which the reaction forces generated during rolling are relieved. In each rolling stand 100, a first hydraulic capsule 4 is arranged with its symmetry axis Y horizontal, while the other two hydraulic capsules 4' and 4" are appropriately inclined with respect to the vertical by an angle of +/−30°, and configured so as to have a piston stroke such to allow the extraction of the roll-holder cartridge 3 in direction of the horizontal arrow D, parallel to the symmetry axis Y, on the side opposite to the first hydraulic capsule 4. The hydraulic cartridges 4, 4' and 4" have a global stroke which comprises, in turn, a first stretch of working stroke for adjusting the radial position of the roll and a second distancing stroke stretch of the piston from the rolling axis X, to allow changing the working rolls 2, 2', 2" by extracting the roll-holder cartridge 3 sideways with respect to the rolling stand 100 in the direction of the arrow D.

The extensions 5, 5', 5" transmit the rotation to the working rolls 2, 2', 2" by connecting them to the respective motors and reducers, not shown in the figures because their features are known to a person skilled in art. The working rolls 2, 2' and 2" are mounted with the respective chocks in the respective yoke shaped supports 6, 6', 6". The yoke supports 6, 6', 6" are provided with a balancing device coaxial with the piston of the respective hydraulic capsules 4, 4', 4" and provided with a fixing mechanism 25, 25', 25", for example of the hammer head type, retractable and rotational with respect to its symmetry axis.

The roll-holder cartridge 3 is also provided with radial guides 20, 20', 21, 21', 22, 22' which allow the sliding movement of the yoke supports 6, 6', 6" and of the respective rolls 2, 2', 2" along the axis of said supports, and the possible extraction from the cartridge 3 by sliding in radial direction with respect to point X', which is along the rolling axis X when the cartridge 3 is mounted in operative position in the rolling stand 100. These yoke supports 6, 6', 6" are also provided with respective pairs of axial resting surfaces 27, 27', 26, 26', 28, 28' which are advantageously obtained either or the supports themselves or on elements complementary to the radial guides 20, 20', 21, 21', 22, 22'.

Indeed, the cartridge 3 is open at said radial guides 20, 20', 21, 21', 22, 22' to allow the radial sliding of the yoke supports 6, 6', 6" of the working rolls without necessarily needing to remove the cartridge.

Before extracting the roll-holder cartridge 3 from the rolling stand 100 is necessary to uncouple the hydraulic capsules 4, 4', 4", the balancing devices and the control extensions 5, 5', 5" from the respective working rolls 2, 2', 2". Means are thus provided for releasing the extensions from the working rolls, while the ends of the rods of the balancing devices are pulled out from the respective grooves of the yoke supports 6, 6', 6" so as not to obstruct the sideways extraction movement of the cartridge 3.

A pair of rails 31 perpendicular to the rolling axis X are provided in the structure of the rolling mill for each rolling stand to allow the transversal sliding of the roll-holder cartridge 3. For this purpose, the roll-holder cartridge 3 is provided with shoes 30 for sliding on the rails 31; alternatively wheels, not shown, may be used for rolling on the rails 31.

To transport the roll-holder cartridge 3, the working rolls 2, 2', 2" must be held fixed with respect to the cartridge 3 to avoid a radial sliding during the movement of the cartridge 3. The rolling stand thus includes retaining devices 52, 53, the simultaneous or disjoined actuation of which may block the position of the yoke supports 6, 6', 6" of the working rolls 2, 2', 2" in the roll-holder cartridge 3 before the sideways extraction of the cartridge from the rolling stand. In particular, the retaining device 53, provided to optionally prevent the exiting of the support 6 and of the respective roll 2 from the cartridge 3, preferably works by gravity. Indeed, a tooth 55 is provided on a supporting frame of the hydraulic capsule 4, suitable to hold the retaining device 53 raised when the cartridge 3 is in working position. By retracting the yoke support 6 towards the capsule 4, such a retaining device 53 remains automatically lifted and thus excluded.

Figure 4:
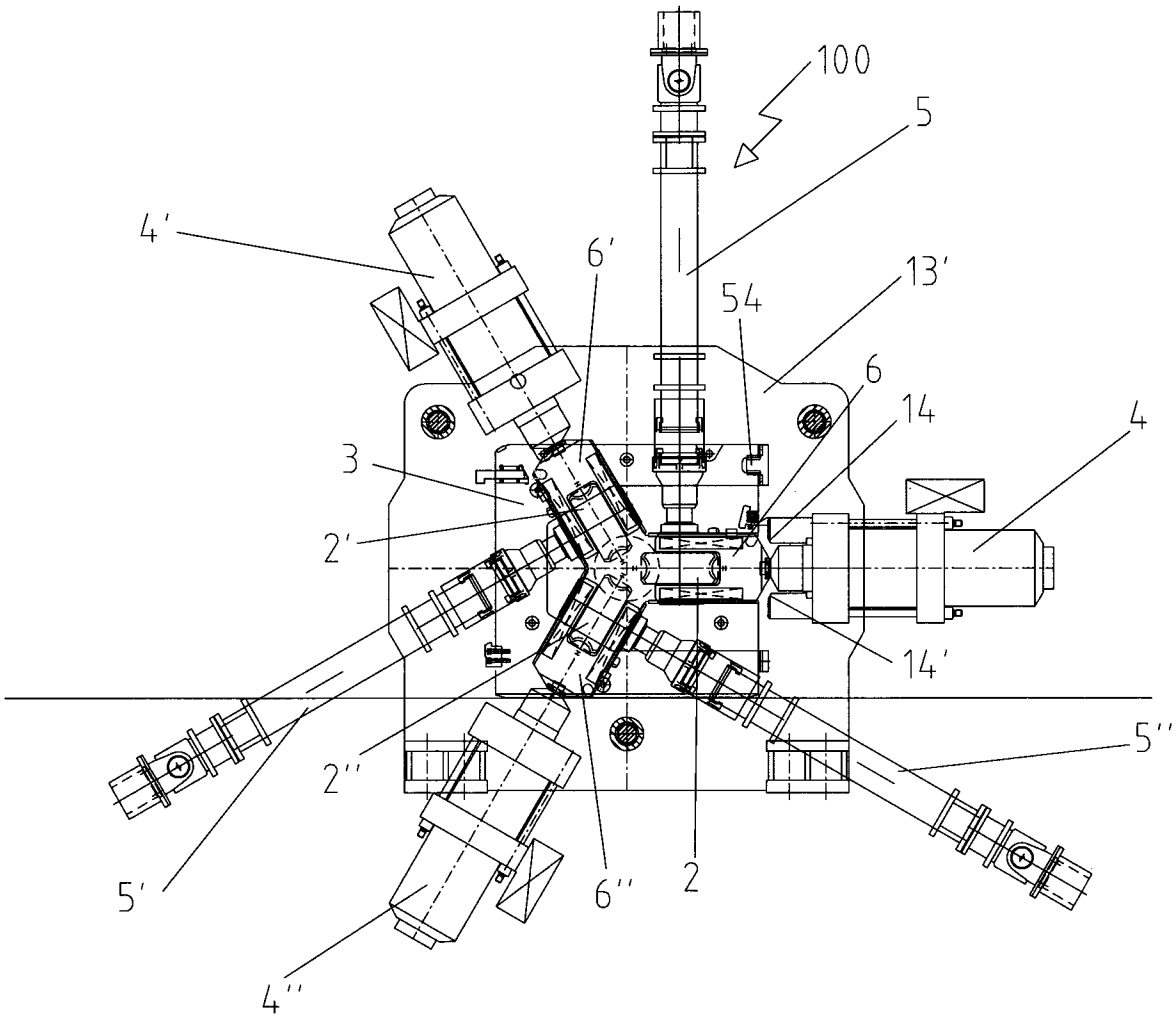
FIG. 4 is a view of the rolling stand in FIG. 1 with the roll-holder cartridge in a step of extracting made in normal operating conditions.
Figure 5:
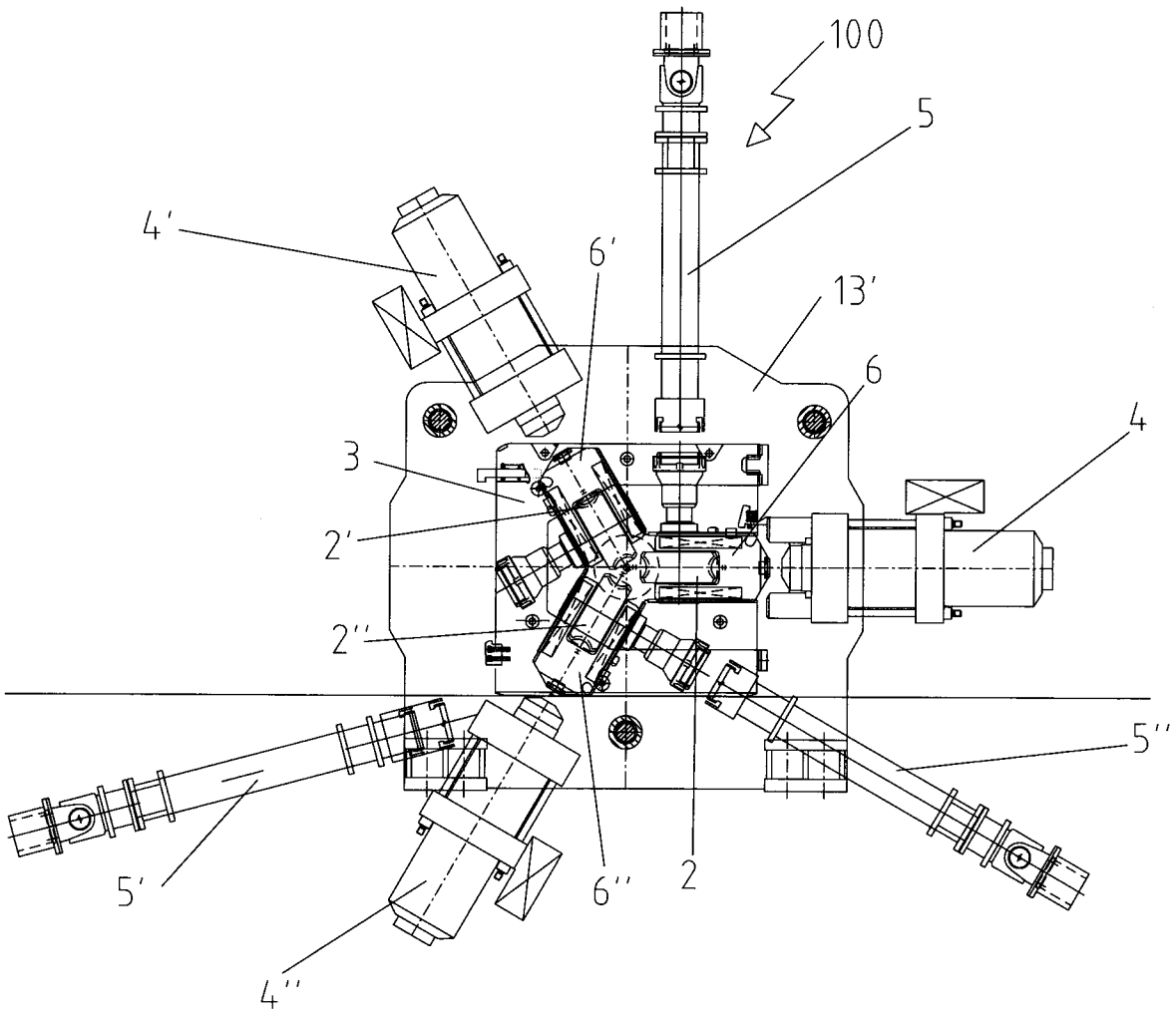
FIG. 5 is a view of the rolling stand in FIG. 1 during a step following the one in FIG. 4.
Figure 6:
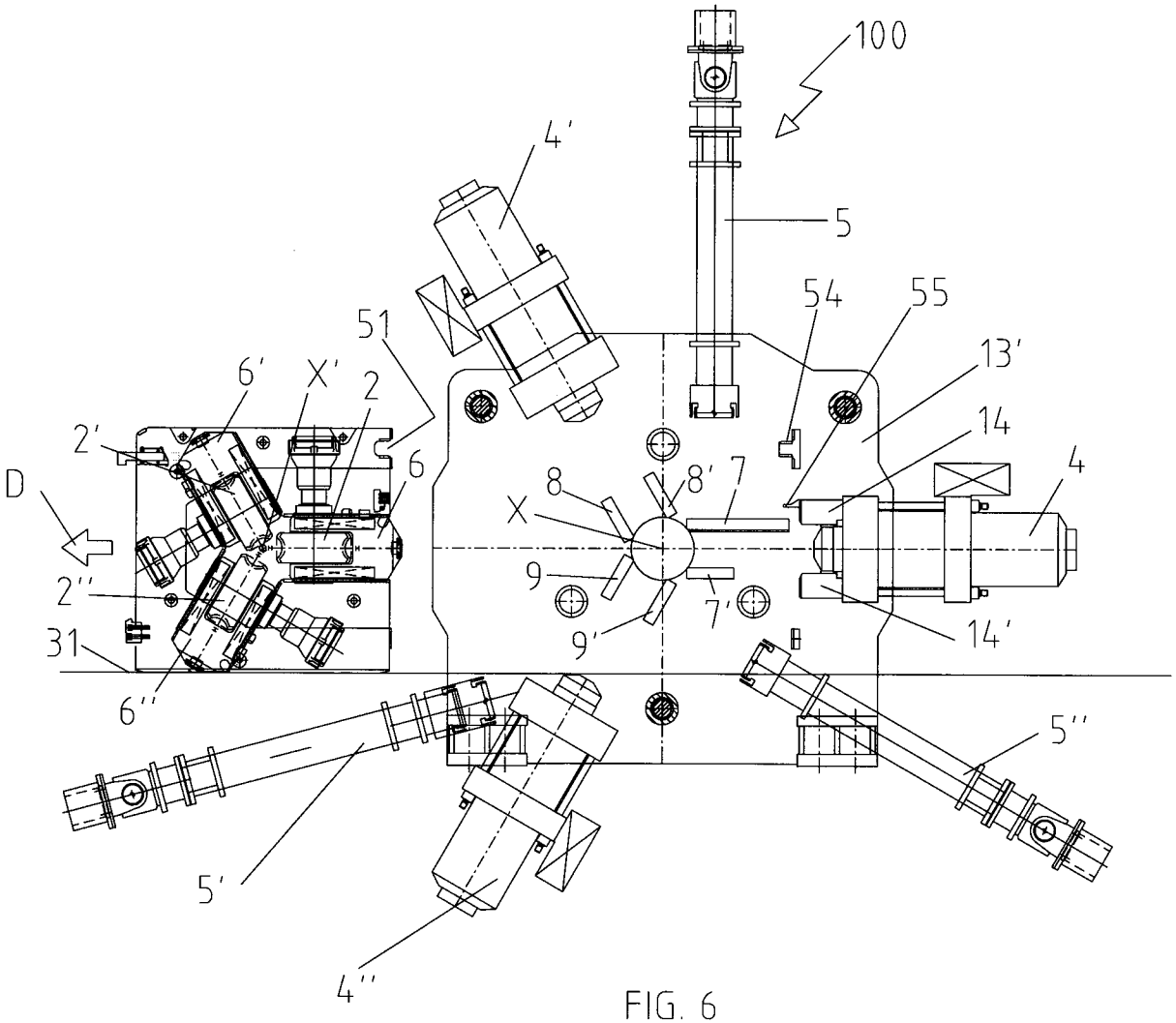
FIG. 6 is a view of the rolling stand in FIG. 1 during a step following the one in FIG. 5.

After having constrained the yoke supports 6, 6', 6", having released them from the respective hydraulic capsules 4, 4', 4" and having released the extensions 5, 5', 5", the extension 5' related to the roll 2' can be moved so as to leave free the passage for the roll-holder cartridge 3, so that it may be extracted sideways in the sense of the arrow D (see FIGS. 4, 5 and 6), for example to carry out normal maintenance.

In case of jamming, which is instead an exceptional, undesired situation, in principle this is not possible given the obstacle created by the possibly crushed tube and by the mandrel inserted in the tube which cannot be pulled out axially. It is thus advantageous to improve accessibility to the rolling axis X for operators, e.g. to cut the tube and the mandrel, not shown since these elements are well known to a person skilled in the art. Because the yoke support 6 of the vertical axis working roll 2 of each stand is mounted on radial guides 22, 22', and the morphology of the cartridge 3 allows the radial extraction of the yoke support itself for normal maintenance operations, the design of the cartridge 3 and of the fixed structure 13 of the stand 100 is such to be able to extract the cartridge 3 easily from the rolling mill also in case of jamming, leaving the yoke support 6 and the corresponding working roll 2 having vertical axis Z within the fixed structure 13.

Figure 2:
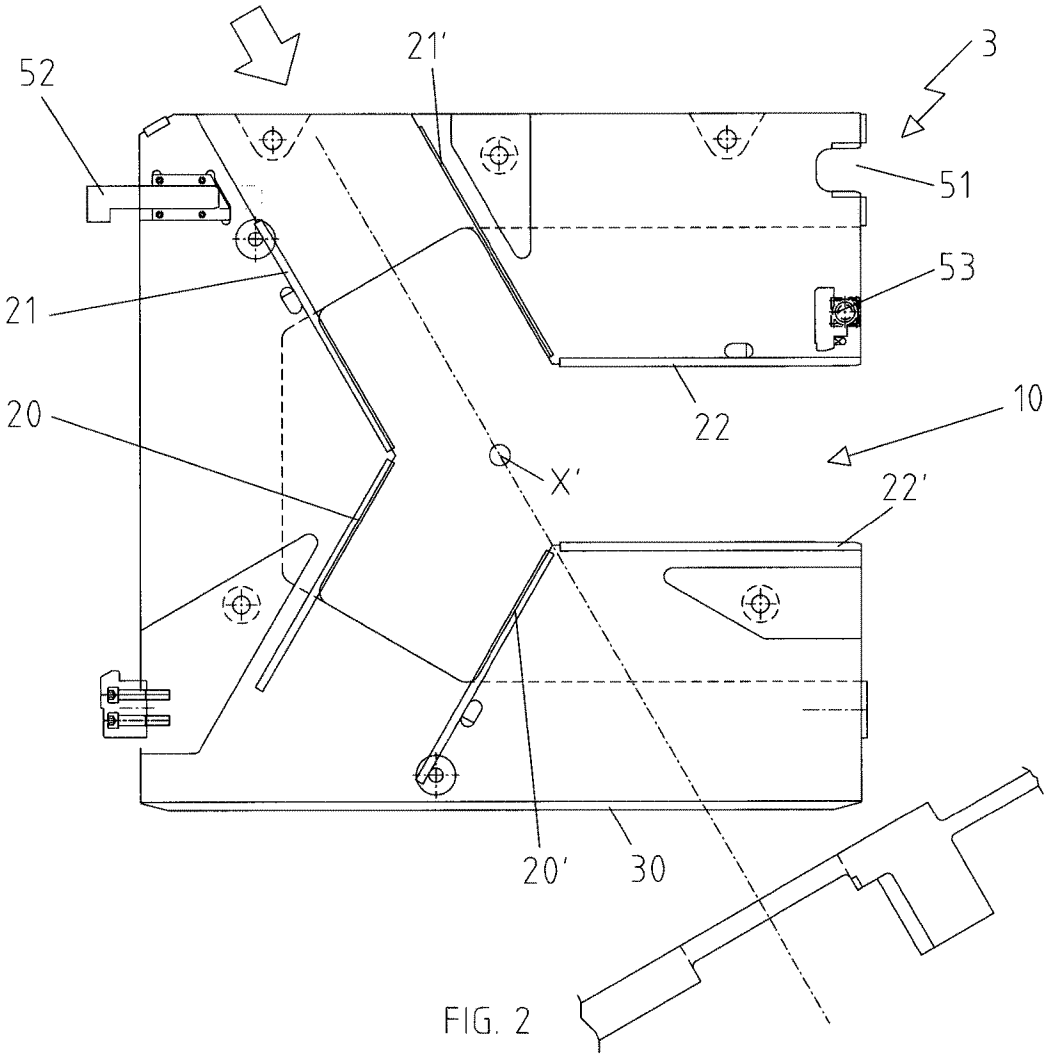
FIG. 2 is a section view taken along a longitudinal plane of a roll-holder cartridge of the rolling stand according to the invention without rolling rolls.
Figure 2A:
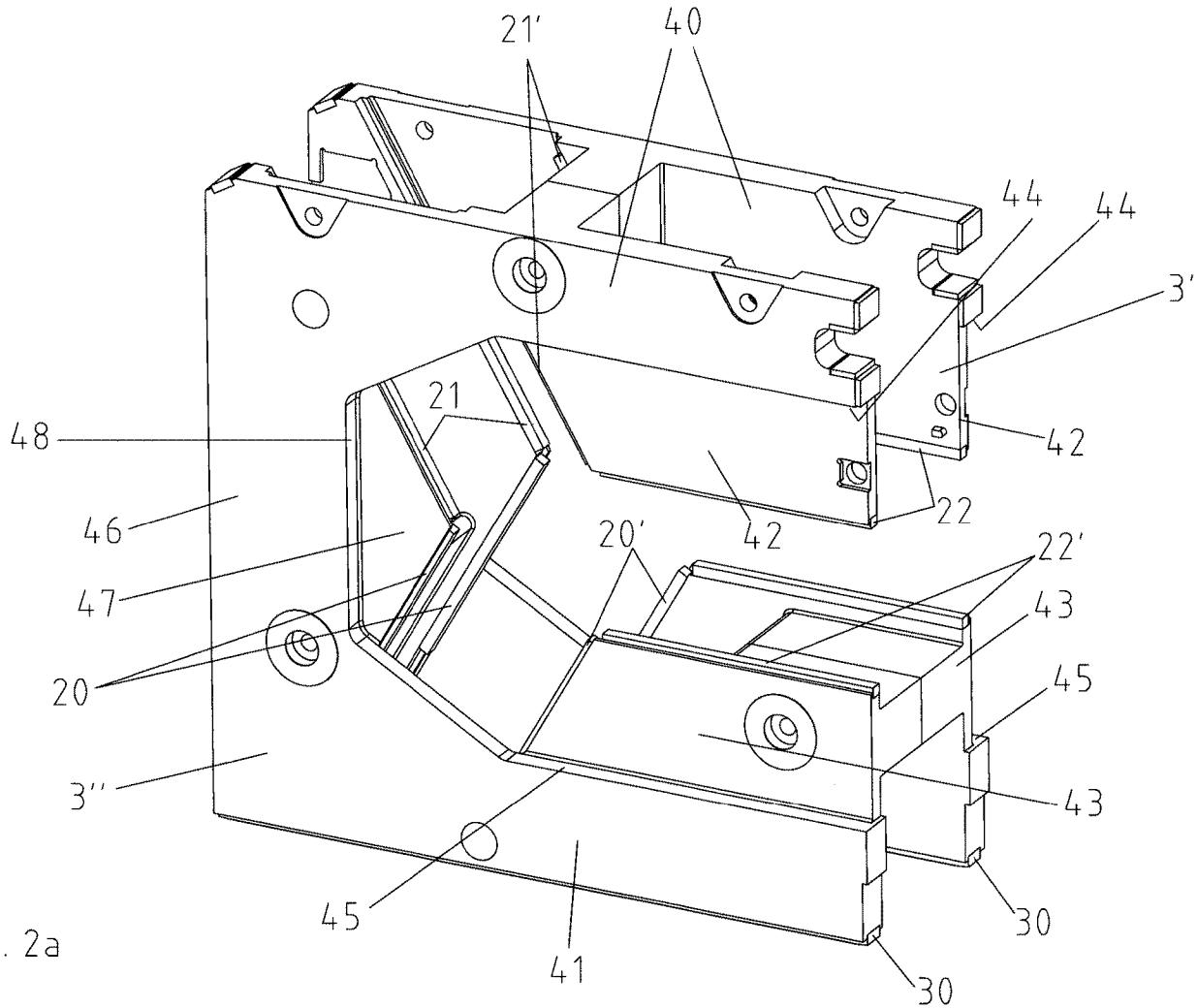
FIG. 2*a* is a perspective view of the roll-holder cartridge in FIG. 2.
Figure 3:
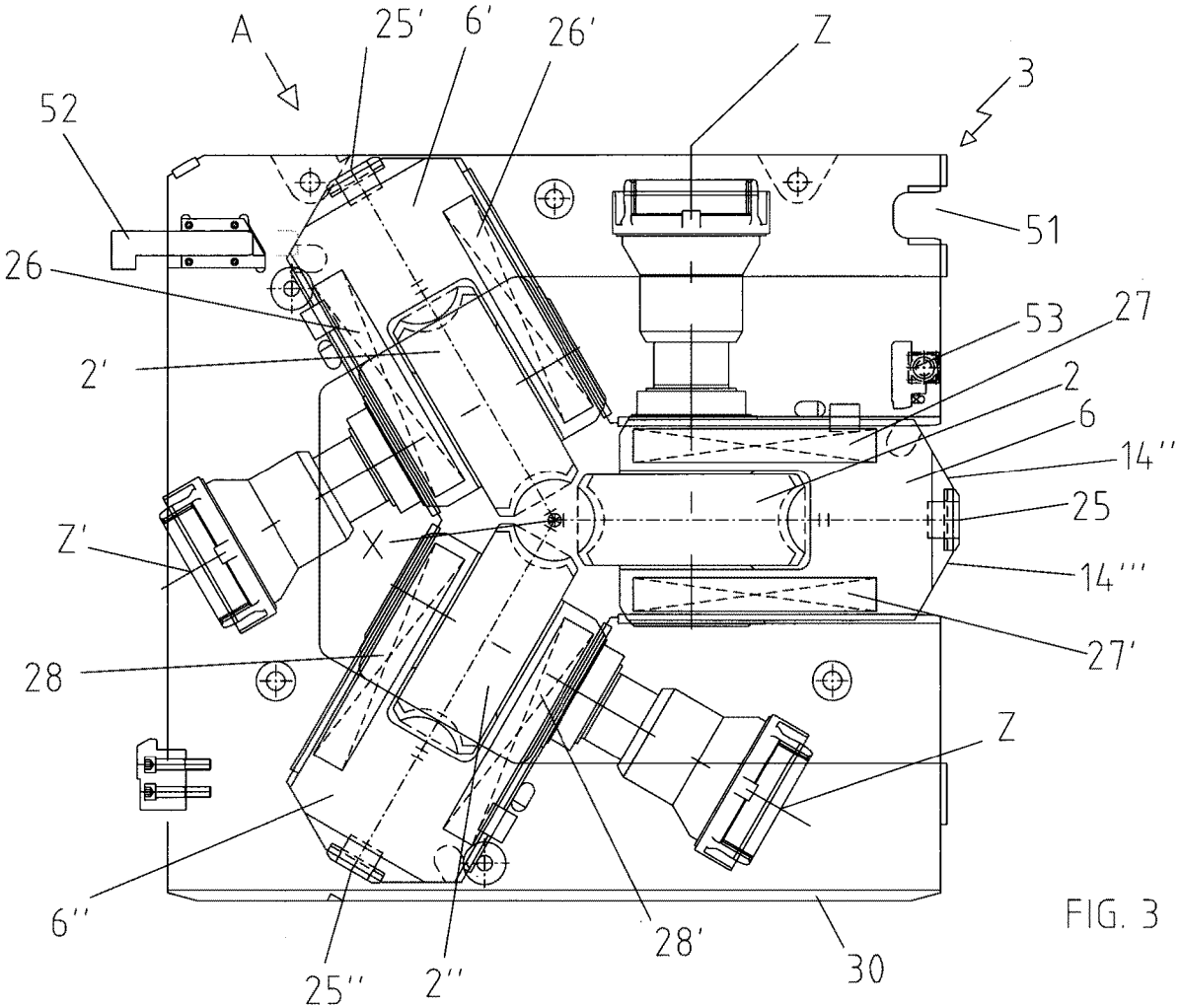
FIG. 3 is a section view taken along a longitudinal plane of a roll-holder cartridge of the rolling stand according to the invention with the rolling rolls and the respective yoke supports.

FIGS. 2 and 2*a* in particular show the structure of the roll-holder cartridge 3 of the rolling stand according to the invention in detail, illustrating how to extract it easily in presence of the jammed tube. The structure of the roll-holder cartridge 3 comprises two side walls 3', 3" parallel to each other, in each of which an opening 10, essentially shaped as a lying letter Y, with the horizontal foot and the two arms inclined on one side with respect to said foot, is obtained. This opening 10 is symmetric with respect to a plane orthogonal to the rolling axis X and containing the axis Y. The two side walls 3', 3" are joined transversally so as to display inner spaces for housing the working rolls 2, 2', 2", the respective yoke supports and part of the respective control extensions.

An upper arm 40 of the side walls 3', 3" has an end portion 42, which is thinner than said upper arm 40. In particular, considering the outer surface of the walls 3', 3", a recess is provided in the passage from the body of the upper arm 40 to said end portion 42, at which a shoulder 44 is provided.

Similarly, the lower arm 41 of the side walls 3', 3" has an end portion 43, which is thinner than said lower arm 41. In particular, considering the outer surface of the walls 3', 3", a recess is provided in the passage from the body from the lower arm 41 to said end portion 43, at which a shoulder 45 is provided.

The body 46 of the side walls 3', 3", which connects the two arms 40, 41 of the walls 3', 3", is also provided with a V-shaped protrusion 47, which is thinner than said body 46. In particular, considering the outer surface of the walls 3', 3", a recess is provided in the passage from the body 46 to said protrusion 47, at which a shoulder 48 is provided.

Radial guides 22 and 21' of the cartridge 3 are provided at the inner edges of the end portions 42; radial guides 22' and 20' of the cartridge 3 are provided at the inner edges of the end portions 43; the radial guides 21 and 20 of the cartridge 3 are provided at the edges of the protrusions 47. The radial guides as a whole delimit an open zone of the cartridge 3, at the opening 10. The recesses defined by the shoulders 44, 45 and 48 all have the same depth in axial sense along the axis X.

The outer fixed structure 13 of the rolling stand has two walls or plates 13', 13", parallel to each other and distanced by a space for housing the roll-holder cartridge. Such walls 13', 13" of the fixed structure are arranged orthogonal to the rolling axis X.

Advantageously, three pairs of elongated rectangular shaped, fixed axial resting surfaces 7, 7', 8, 8', 9, 9' are provided on the inner side of each pair of opposite walls 13', 13" of the fixed structure 13, which surfaces define a space for inserting the cartridge 3 and project from the inner surface of said side walls, the thickness in the axial sense of which is substantially equal to the depth of the recesses defined by the shoulders 44, 45 and 48. The fixed axial resting surfaces 7, 7', 8, 8', 9, 9', during the operation of the rolling stand allow the axial resting of the corresponding axial resting surfaces 27, 27', 26, 26', 28, 28' of the yoke supports 6, 6', 6".

In particular, the rolling stand is configured so that when the cartridge 3, containing all three working rolls 2, 2', 2" and the respective yoke supports 6, 6', 6", is inserted in the rolling stand:

- the two pairs of fixed axial resting surfaces 8, 8', one pair on each said inner side wall of the fixed structure 13, are at the respective pairs of radial guides 21, 21' of the cartridge 3 and of the axial resting surfaces 26, 26' of the yoke support 6';
- the two pairs of fixed axial resting surfaces 9, 9', one pair on each said inner side wall of the fixed structure 13, are at the respective pairs of radial guides 20, 20' of the cartridge 3 and of the axial resting surfaces 28, 28' of the yoke support 6";
- and the two pairs of fixed axial resting surfaces 7, 7', one pair on each said inner side wall of the fixed structure 13, are at the respective pairs of radial guides 22, 22' of the cartridge 3 and of the axial resting surfaces 27, 27' of the yoke support 6.

Advantageously, the upper axial resting surfaces 7 have a longitudinal supporting protrusion 50 to support the corresponding upper axial resting surface 27 of the yoke support 6 of the vertical rotation axis working roll 2. Alternatively, the protrusion 50 may be provided in the axial resting surfaces 27 to rest on the upper axial resting surface 7.

In a preferred variant, the upper axial resting surfaces 7 of the inner side walls of the fixed structure 13 is longer than the corresponding upper axial resting surfaces 27 of the yoke support 6, so as to support the weight of the yoke support 6 during all steps of separating and reinserting it into the guides 22, 22' present in the cartridge 3.

Furthermore, supporting teeth 50 can be provided positioned alternatively between the lower axial resting surfaces 7' and 27'.

Figure 7:
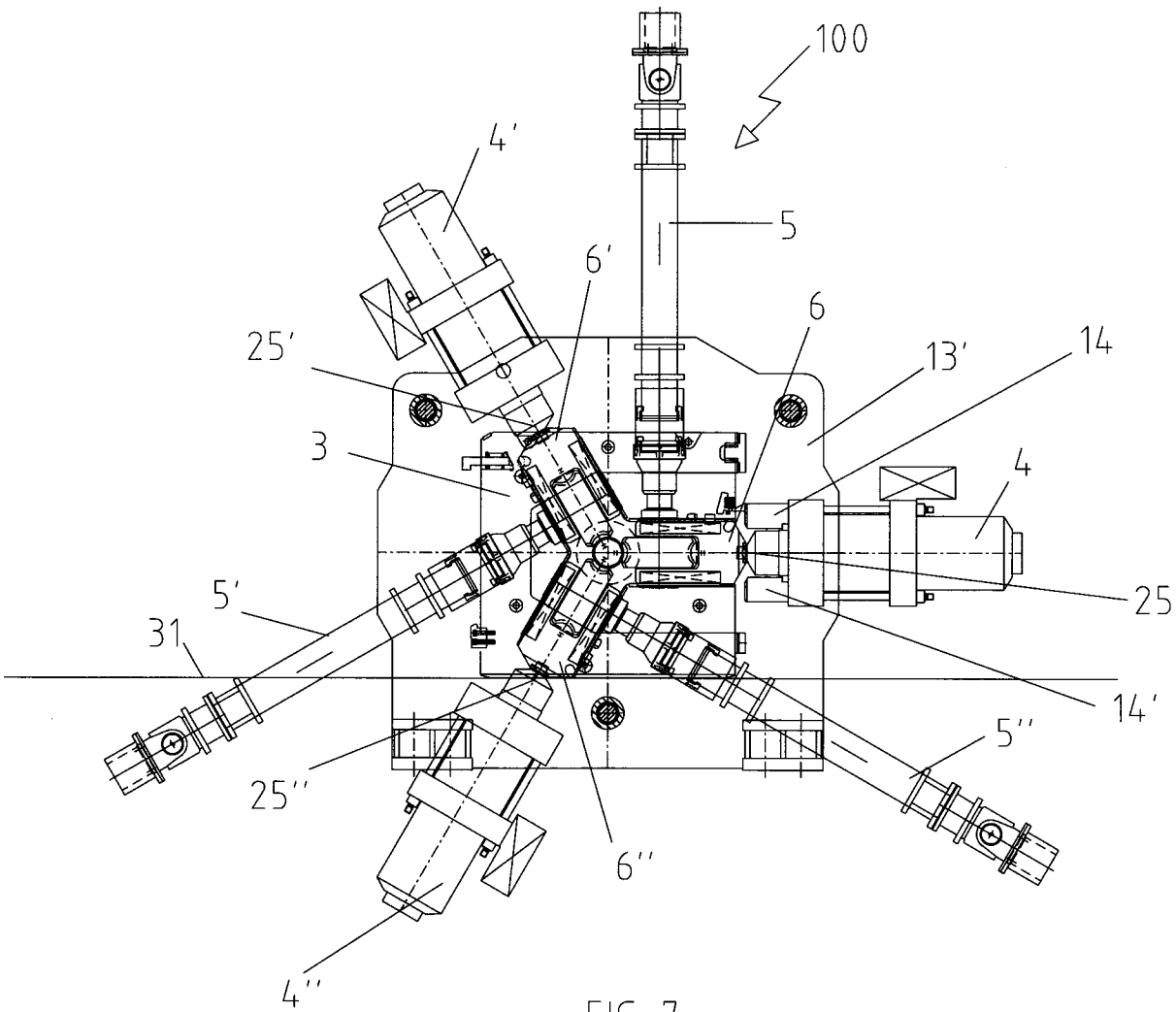
FIG. 7 is a view of the rolling stand in FIG. 1 with the roll-holder cartridge during a step of maximum opening of the chocks for a first emergency intervention in case of jamming or in all cases to gain a visual access inside the cartridge.
Figure 8:
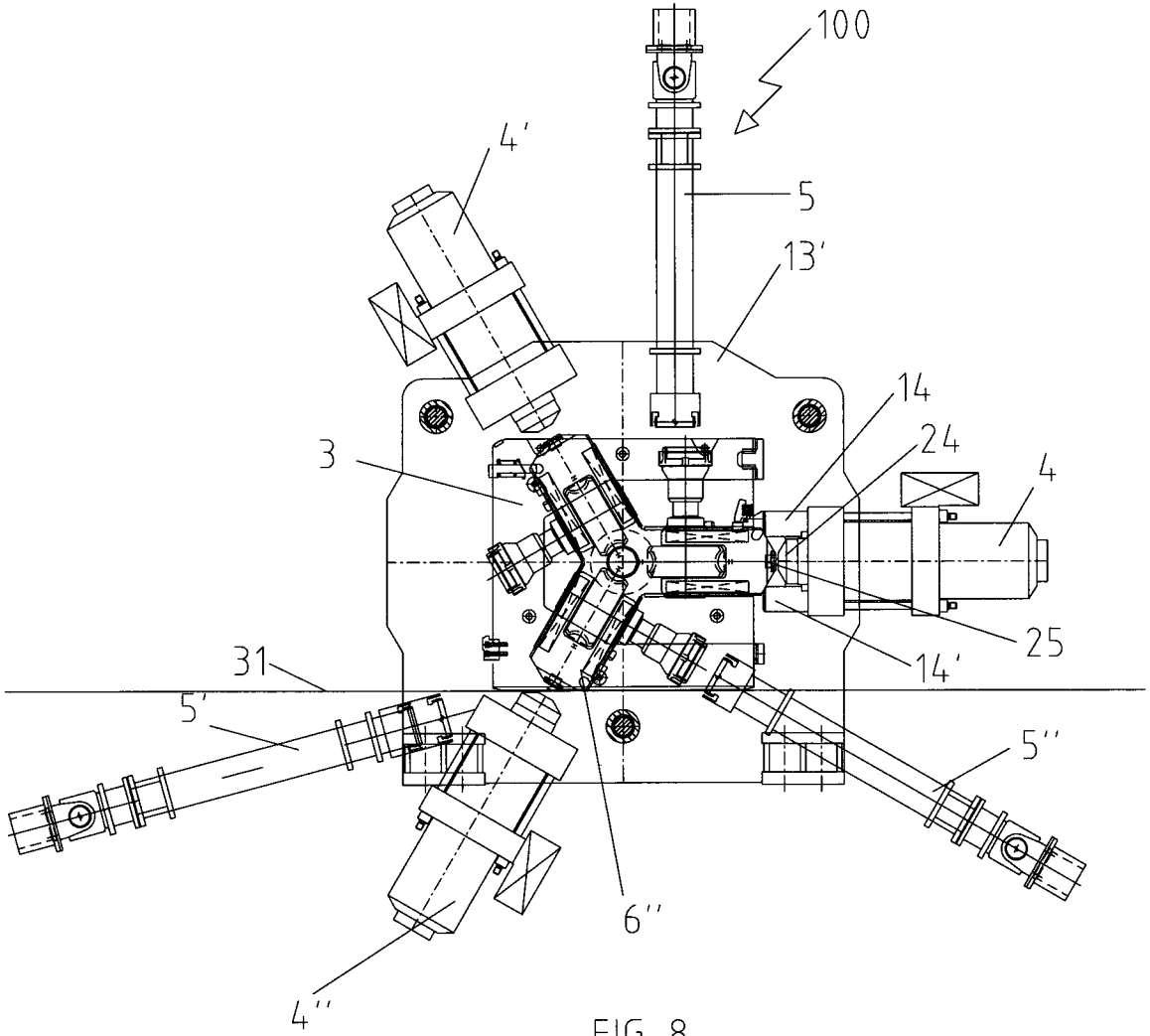
FIG. 8 is a view of the rolling stand in FIG. 1 during a step following the one in FIG. 7.
Figure 9:
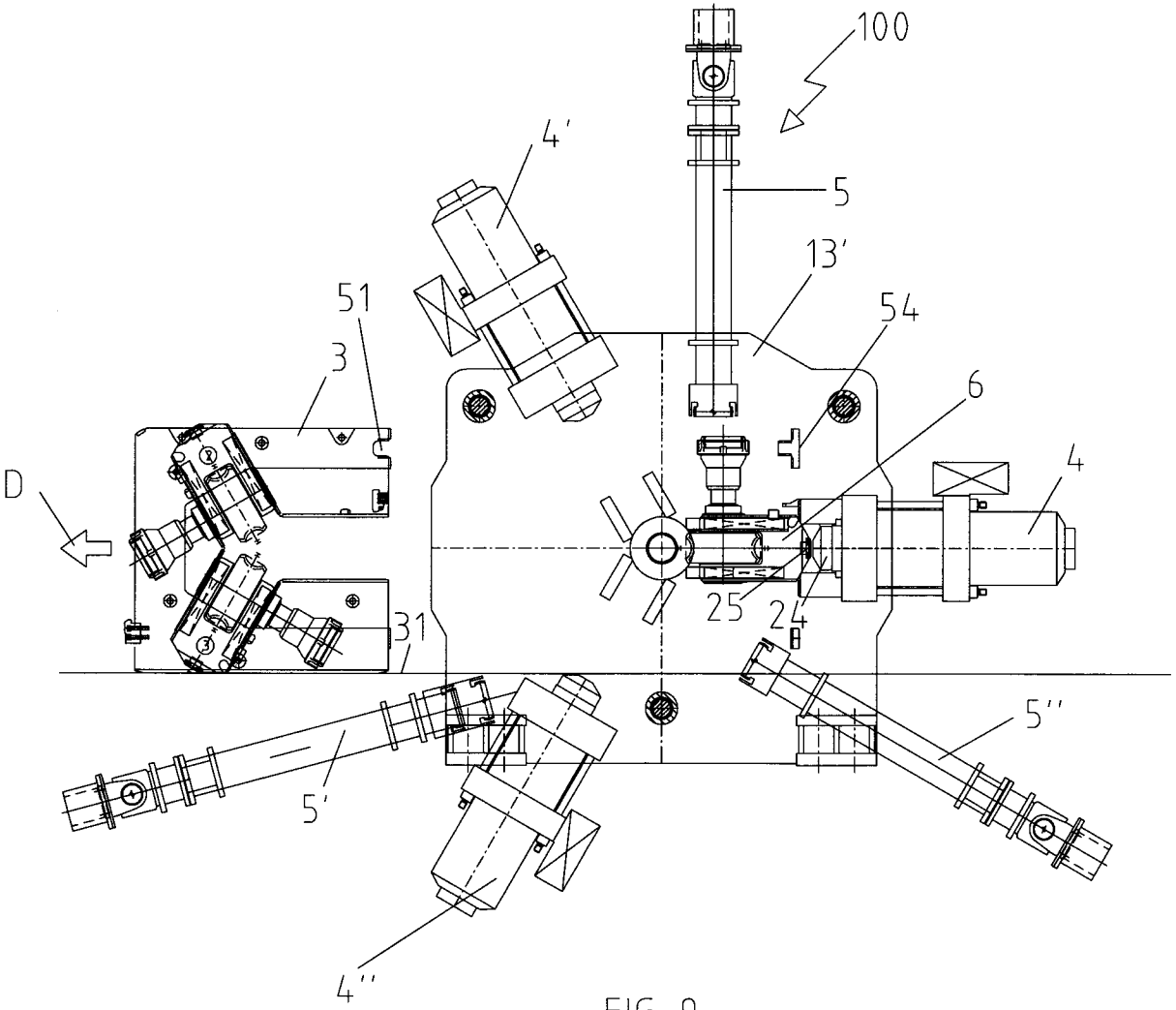
FIG. 9 is a view of the rolling stand in FIG. 1 in a step following the one in FIG. 8 with cartridge extracted and vertical axis roll hanging from the structure of the stand.
Figure 12:
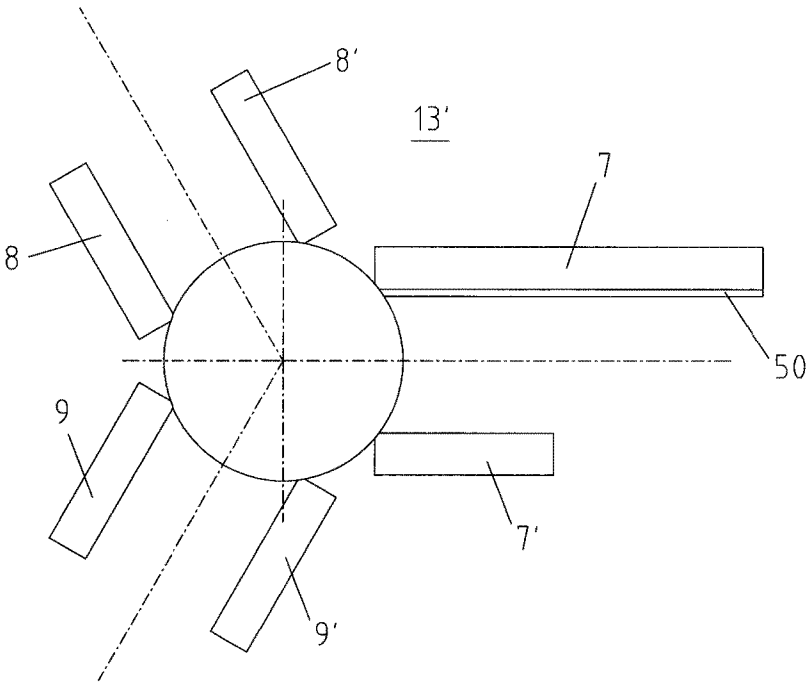
FIG. 12 is a side view of part of an inner wall of the structure of the rolling stand of the invention.
Figure 10:
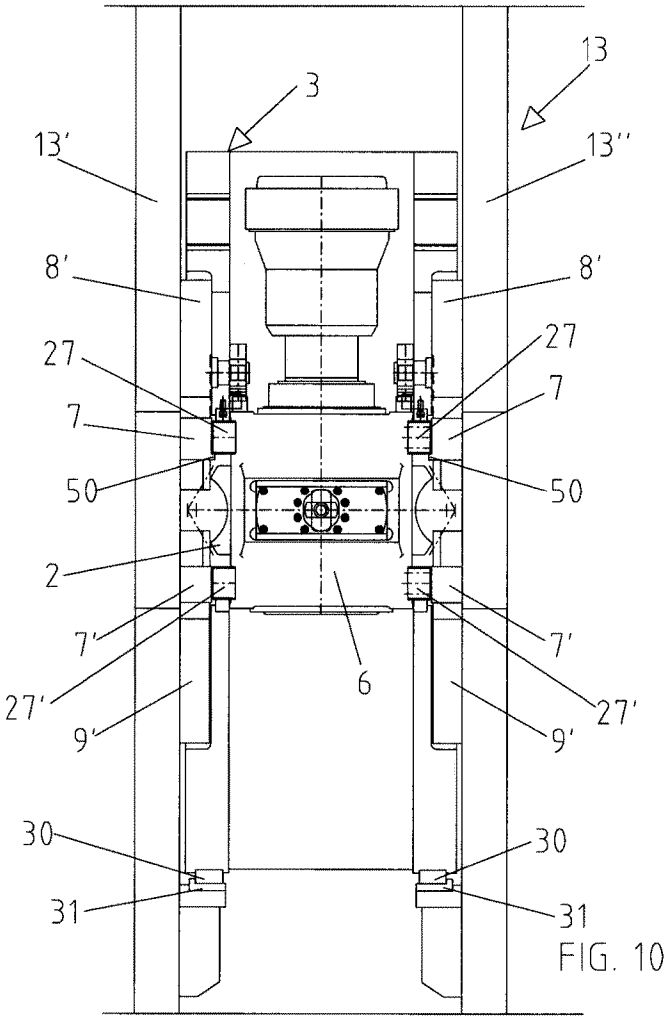
FIG. 10 is a side view of the roll-holder cartridge in FIG. 2.
Figure 13:
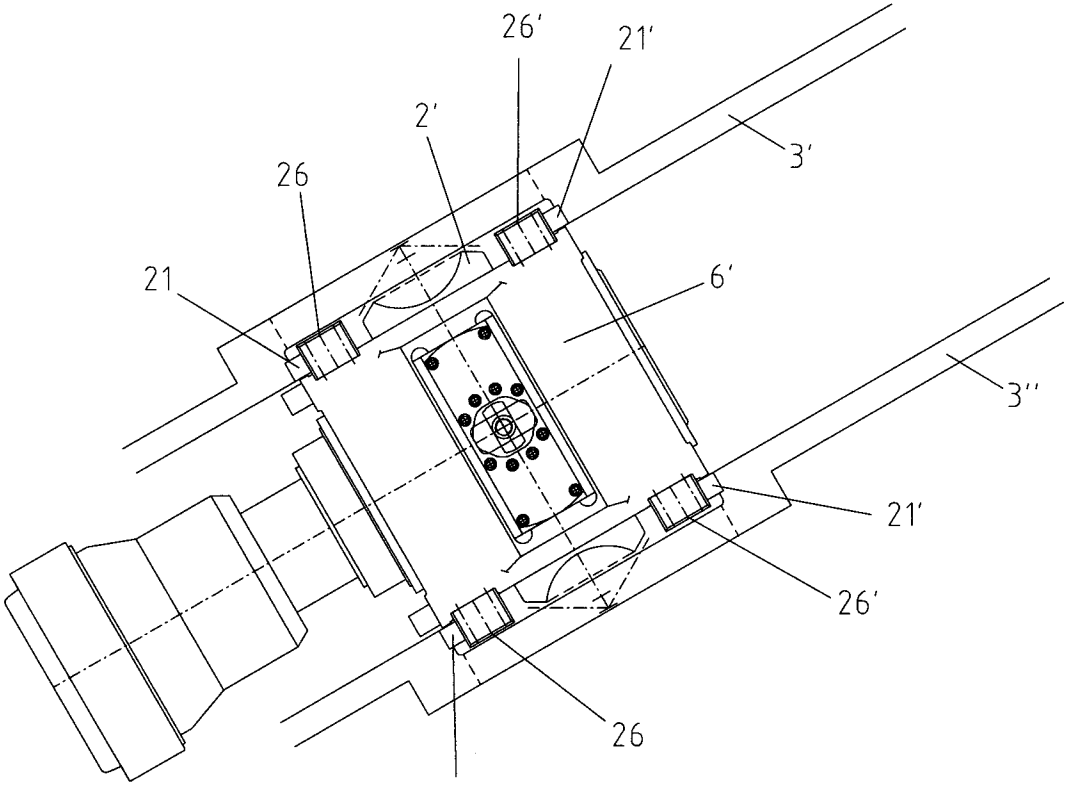
FIG. 13 is a partial view in direction A of the roll-holder cartridge in FIG. 3.
Figure 11:
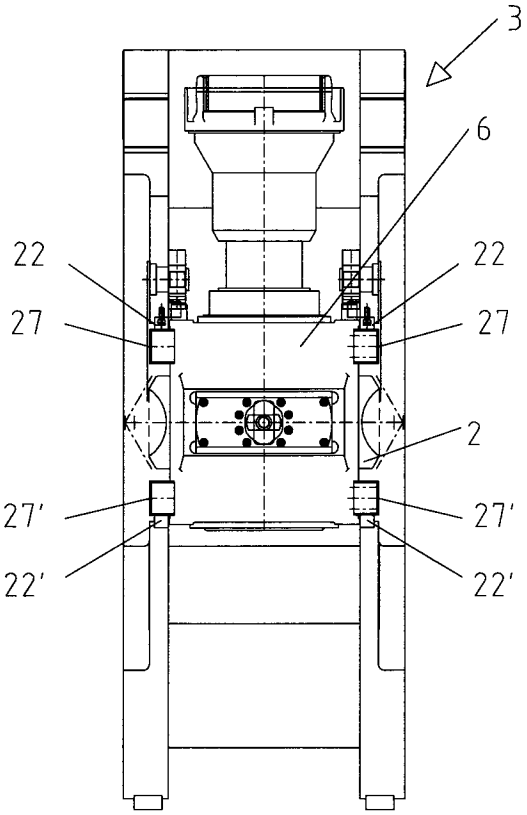
FIG. 11 is a side view of the roll-holder cartridge in FIG. 3.

In this manner, the roll-holder cartridge 3 can be detached from the assembly comprising the yoke support 6 and the working roll 2, because said assembly is supported by the cooperation of the axial resting surfaces 27 of the yoke support 6 with the axial resting surfaces 7 of the walls 13', 13" of the fixed structure 13. The cartridge 3 can be easily extracted sideways from the left, with respect to the illustration in FIGS. 7, 8 and 9, because the cartridge thus configured can be pulled out from the jammed tube even before cutting it with the blow torch, since the Y-shaped opening 10 has a sufficient width. Indeed, the shape of the open zone of the cartridge 3 allows to extract the cartridge itself, in the case of the arrangement of the stand 100 shown in the figures, leftwards from the right, with regards to the arrangement shown in the figures, thus leaving a wide space for intervening on the jammed tube.

In an advantageous variant, in addition to the cooperation of the axial resting surfaces 27 with the fixed axial resting surfaces 7 of the fixed structure 13, it is possible to provide a fixing device in the rolling stand 100 to fix the yoke support 6 and the respective vertical axis roll 2 to the hydraulic capsule 4 thereof. The capsule 4 is anchored by coupling the yoke support 6 to the capsule 4 which, as the other capsules 4' and 4", is integral with the fixed structure 13. For such a purpose, two resting elements 14, 14' are provided with two contact surfaces, forming a "V" shaped seat on which the corresponding surfaces 14",14'" of the yoke support 6 rest, preferably inclined with respect to the horizontal axis Y, so as to keep the yoke support 6 and respective roll 2 aligned with axis Y, and centered in the 'V'-shaped seat. The resting surfaces 14",14'" are configured so as to arrange the axial resting surfaces 27, 27' of the yoke support 6 aligned with the radial guides 22 and 22' when the roll-holder cartridge 3 enters and exits from the fixed structure 13. Furthermore, a fixing or balancing mechanism 25 of the yoke support 6 is provided, coaxial to the piston 24 of the hydraulic capsule 4 provided with a hammer head, which is retractable and rotational with respect to the axis Y thereof. The resting elements 14, 14' produce the reactions needed to further support the supporting assembly of yoke support 6 and roll 2 when the cartridge 3 is extracted from the fixed structure 13 and remains fixed to the fixing mechanism 25 and in all cases supported by the teeth 50.

The stroke of the capsules may be taken to more than 200 mm for a rolling mill of tubes up to 10"¾, because the rolls inclined in cartridge changing position, and thus with the locking device engaged, do not interfere with the jammed tube. A stroke of approximately 220 mm is in all cases adequate for the required performance of the process, in particular considering the use of a capsule with four-way servo valve.

A further advantage is in that there is a respective recess 51 adapted to house a corresponding protrusion 54 integrally fixed to the fixed structure 13 (FIGS. 6 and 9) at the ends of the upper arms 40 of the side walls 3', 3" of the cartridge. This precaution prevents an "opening" of the cartridge 3, which is less rigid for the presence of the Y-shaped openings 10 in its side walls, during the stresses during the operation of the rolling plant. Alternatively, the recesses 51 may be provided in the fixed structure 13 and the respective protrusions 54 provided in the upper arms 40 of the cartridge 3.

The extraction procedure of the roll-holder cartridge 3, in the case of jamming of the tube in the rolling stand of the invention thus occurs as follows:

a) blocking the two rolls 2', 2", with symmetry axis inclined with respect to the horizontal, to the roll-holder cartridge 3 in predetermined design extraction position so as to clear the path of the roll-holder cartridge 3 when it is extracted from the supporting structure 13 outwards, maintaining instead released the retaining device 53 between the yoke support 6 and the first working roll 2 with vertical rotation axis and roll-holder cartridge 3;

b) releasing the control extensions 5, 5', 5" from the three rolling rolls and positioning the extensions so as to leave free the path of the roll-holder cartridge 3 from the supporting structure 13 of the rolling stand outwards, c) extracting the roll-holder cartridge from the working position in the rolling stand to the extracted position by means of a side translation, leaving the yoke support 6 with the respective first vertical rotation axis working roll hanging from the supporting structure of the rolling stand.

In particular, the yoke support 6 and the respective first roll 2 remain hanging by virtue of the cooperation between the two axial resting surfaces 27 of the yoke support 6 and the corresponding two fixed axial resting surfaces 7 of the fixed supporting structure 13 of the rolling stand.

In addition to the cooperation of the axial resting surfaces 27 with the fixed axial resting surface 7, it is possible to provide also a fixing of the yoke support 6 and of the respective working roll 2 to its hydraulic capsule 4.

After removing the jamming and freeing the rolling mill from the tube and from the damaged mandrel, the roll-holder cartridges 3 are returned to position, by reinserting them in the rolling mill, having provided appropriate lead-ins between the axial resting surfaces 27, 27' of the yoke support 6 and the radial guides 22, 22' on the roll-holder cartridge 3, to allow the automatic reinsertion of the yoke support 6 hanging horizontally from the axial resting surfaces 7 of the walls 13', 13" of the fixed structure 13.

The present invention provides the possibility of completely extracting the roll-holder cartridge 3 using the normal cartridge changing devices existing in existing rolling mills, thus eliminating all the factors which prevent such an extraction when the tube and mandrel operating therein are blocked in the machine. Obviously, the operative advantage of this roll-holder cartridge extraction method in case of jamming is very important and allows to reduce the rolling mill downtime drastically for removing jamming and further allows the operators to operate with much improved conditions of accessibility and safety compared to the prior art.

The invention claimed is:

1. A rolling stand for rolling a tube defining a rolling axis, comprising:

a supporting structure, a roll-holder cartridge configured to go from a working position inside the supporting structure, at the rolling axis, to an extracted position outside the supporting structure with a transverse movement with respect to the rolling axis, three rolling rolls, each of which having a respective support, arranged in the roll-holder cartridge with respective symmetry axes arranged at 120° with respect to one another, a first roll of said three rolling rolls having the respective symmetry axis arranged horizontally and the respective rotation axis arranged vertically, at least one hydraulic capsule for each rolling roll, in order to adjust the radial position of the respective rolling roll, fixed to the supporting structure with a respective thrust cylinder, the at least one hydraulic capsule being configured to allow the respective thrust cylinder to cover a sufficient distancing stroke from the rolling axis to allow to clear the path of the roll-holder cartridge between the working position and the extracted position, wherein the roll-holder cartridge has two first walls facing each other, each first wall having an opening equal to that of the other first wall and defining three branches, wherein a first branch of the opening has elongated shape along the horizontal symmetry axis of the first roll, and wherein a second branch and a third branch have a symmetry axis arranged at a 120° angle with respect to the symmetry axis of the first roll, wherein the first branch is open at an end thereof coinciding with a side of the roll-holder cartridge, wherein the supporting structure has two second walls facing each other and there are three pairs of first axial resting surfaces on the inner surface of each of said two second walls, wherein each pair of first axial resting surfaces, when the cartridge is in said working position, is arranged so as to be in the first, second and third branch of the openings of the first walls of the roll-holder cartridge and facing, along the direction of the rolling axis, to corresponding pairs of second axial resting surfaces integral with the support of the rolling rolls, whereby the rolling forces directed along the rolling axis are directly discharged from the supports to the supporting structure.

2. A rolling stand according to claim 1, wherein the first roll and the respective support can slide within the cartridge in radial direction with respect to the rolling axis and at least two pairs of first axial resting surfaces and of second axial resting surfaces, arranged in the first branch of the openings aligned with the first roll, comprise a supporting protrusion adapted to support said first roll and the respective support vertically, in case of extraction of the roll-holder cartridge from the supporting structure caused by a jamming of the tube.

3. A rolling stand according to claim 2, wherein said supporting protrusion is arranged either on a first axial resting surface or on a second axial resting surface of said at least two pairs of first axial resting surfaces and of second axial resting surfaces.

4. A rolling stand according to claim 1, wherein respective pairs of radial guides are provided at the first, second and third branches of the openings of the first walls, and the roll-holder cartridge is open at said pairs of radial guides to allow a sliding and a radial extraction of the supports and of the respective rolling rolls.

5. A rolling stand according to claim 1, wherein there is provided a recess, on an edge of the outer perimeter of the two first was of the roll-holder cartridge, adapted to house a corresponding protrusion integrally fixed to the supporting structure, or vice versa.

6. A rolling stand according to claim 1, wherein the first walls are arranged symmetrically with respect to each other, and each comprises:

a first arm provided with a first end portion thinner than the body of said first arm so that, considering the outer surface of the first walls, there is provided a recess in the passage from the body of the first arm to said first end portion, at which a first shoulder is provided;

a second arm provided with a second end portion thinner than the body of said second arm so that, considering the outer surface of the first walls, there is provided a recess in the passage from the body of the second arm to said second end portion, at which a second shoulder is provided;

a body, which connects first arm and second arm, provided with a V-shaped protrusion thinner than said body so that, considering the outer surface of the first walls, there is provided a recess in the passage from said body to said protrusion, at which a third shoulder is provided.

7. A rolling stand according to claim 6, wherein the protrusions defined by the first, second and third shoulders have the same depth when measured in direction parallel to the rolling axis.

8. A rolling stand according to claim 7, wherein the three pairs of first axial resting surfaces protrude from the inner surface of each of said two second walls of the supporting structure and have a thickness along the rolling axis essentially equal to the depth of the recesses defined by the first, second and third shoulders.

9. A rolling stand according to claim 6, wherein when the roll-holder cartridge is in the working position:

two first pairs of the first axial resting surfaces, one first pair on each second wall, are at respective two first pairs of radial guides of the first walls and of respective two first pairs of the second axial resting surfaces;

two second pairs of the first axial resting surfaces, one second pair on each second wall, are at respective two second pairs of radial guides of the first walls and of respective two second pairs of the second axial resting surfaces;

and two third pairs of the first axial resting surfaces, one third pair on each second wall, are at respective two third pairs of radial guides of the first walls and of respective two third pairs of the second axial resting surfaces.

10. A rolling stand according to claim 1, comprising a locking device for locking the position of the supports within the roll-holder cartridge.

11. A rolling stand according to claim 1, comprising a balancing device of the support of the first roll, having vertical rotation axis, said balancing device being coaxial to a piston of the corresponding hydraulic capsule, said piston being provided with a hammer head that is retractable and rotational with respect to the axis thereof.

12. A rolling stand according to claim 1, wherein the hydraulic capsules are capsules controlled by means of a four-way servo-valve.

* * * * *